United States Patent [19]

Gillenkirch

[11] 4,225,001

[45] Sep. 30, 1980

[54] BAGGING MACHINE WITH TWO WEIGHING SCALES AND TWO REVERSIBLE CONVEYORS

[76] Inventor: Gerd Gillenkirch, 110 Schmachtendorfer Strasse 110, D 4200 Oberhausen-Sterkrade-Nord, Fed. Rep. of Germany

[21] Appl. No.: 904,432

[22] Filed: May 10, 1978

[30] Foreign Application Priority Data

May 10, 1977 [DE] Fed. Rep. of Germany ..... 2720901

[51] Int. Cl.[2] ..... G01G 13/08

[52] U.S. Cl. ..... 177/90; 177/119; 177/123

[58] Field of Search ..... 177/59, 90, 98, 99, 177/100, 119–123

[56] References Cited

U.S. PATENT DOCUMENTS

| | | | |
|---|---|---|---|
| 1,856,884 | 5/1932 | Popov | 177/90 |
| 2,741,450 | 4/1956 | Thayer | 177/120 X |
| 3,720,276 | 3/1973 | Banks | 177/122 |
| 3,814,196 | 6/1974 | McClusky | 177/123 X |

*Primary Examiner*—Joseph W. Hartary

*Attorney, Agent, or Firm*—Brooks, Haidt, Haffner & Delahunty

[57] ABSTRACT

A bagging machine comprising a bagging scale, a conveyor belt for bulk filling, and a conveyor belt for dribble filling operation, both belts being coupled with a continuous weighing means operating or reversing the drive of the conveyor belts, so that after bulk filling the respective conveyor belt is reversed to discharge into another outlet while the respectively other conveyor belt is operated for dribble filling until the precise filling weight is attained.

4 Claims, 3 Drawing Figures

BAGGING MACHINE WITH TWO WEIGHING SCALES AND TWO REVERSIBLE CONVEYORS

BACKGROUND OF THE INVENTION

Bagging machines are mainly known as non-stationary machinery in agricultural industry and engineering, which are used to fill goods into bags. In such machinery the goods are elevated from a hopper on a belt conveyer to a certain level and then dumped into a sack or bag standing on a weighing machine. When the predetermined filling weight has been achieved the belt conveyor is automatically switched off.

In the known bagging machines there is the disadvantage that as the filling weight is approached the conveyor belts must be slowed or switched off. They are stopped when one bag is filled and when another bag is placed onto the weighing machine.

SUMMARY OF THE INVENTION

The present invention relates to a bagging machine for piece goods, which comprises a bagging scale, for both bulk and dribble filling operations.

The primary object of the invention is to increase capacity of such bagging machinery, and to provide a machine which permits precise weighing already through the feed hopper or the feed chute.

In accordance with the present invention, the bagging machine comprises two conveyor belts having the same or different widths, for conveyance of the goods, at the same or different belt speeds. One of the two conveyor belts serves for bulk filling operation while the other belt is provided for dribble filling; in accordance with another feature of the present invention both conveyor belts are reversible. This arrangement permits continuation of the filling operation with the aid of the conveyor belt for dribble filling when the bulk filling step has been terminated, while the belt for bulk filling is reversed to now convey the goods into the chute or the hopper underneath the other end of the conveyor belt.

In accordance with the present invention, the chutes or hoppers are provided with closure lids for electrical or hydraulic operation. At the same time they are coupled with continuous or delivery weighing means which operates the drive or the reversing drive, respectively, of the conveyor belts. It is expedient that the conveyor belts be designed as rubber belts without cleats; however, the surface structure depends on the goods to be conveyed which may be potatoes, onions, carrots, nuts, coal or the like.

In a manner know per se, the entire bagging machine is suited for displacement on rollers.

Other objects and advantages of the present invention will be readily apparent from the following description of the drawing in which one embodiment of the invention is shown.

Figure 1:
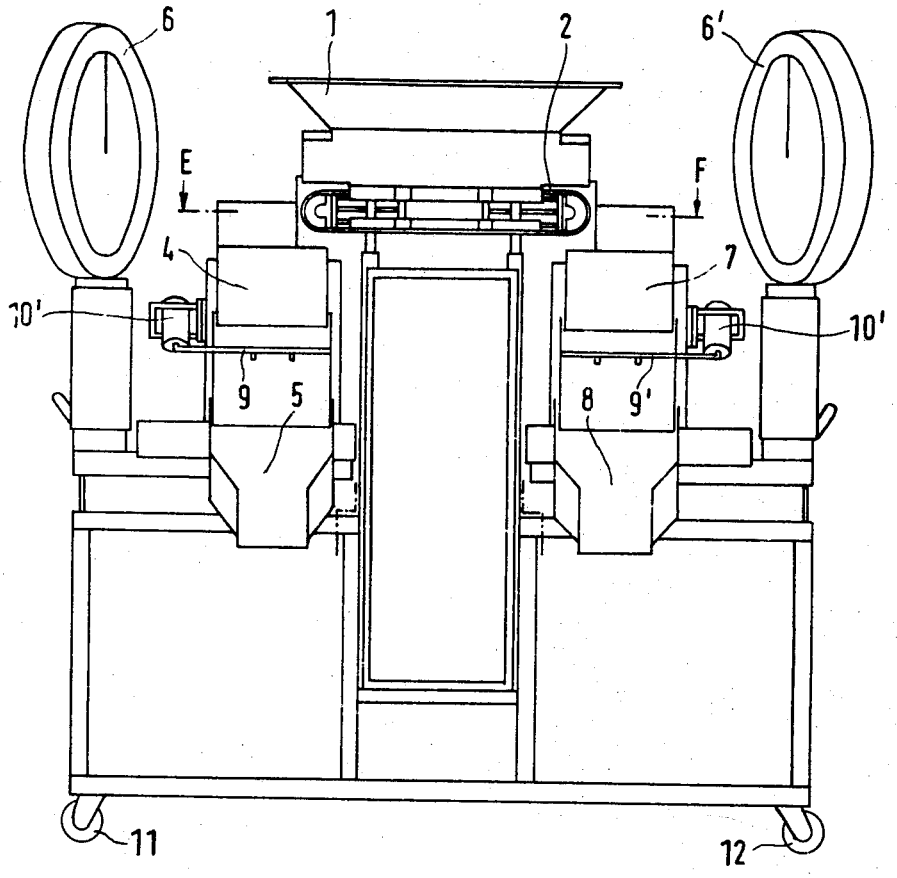
FIG. 1 is a front view of the machine.
Figure 2:
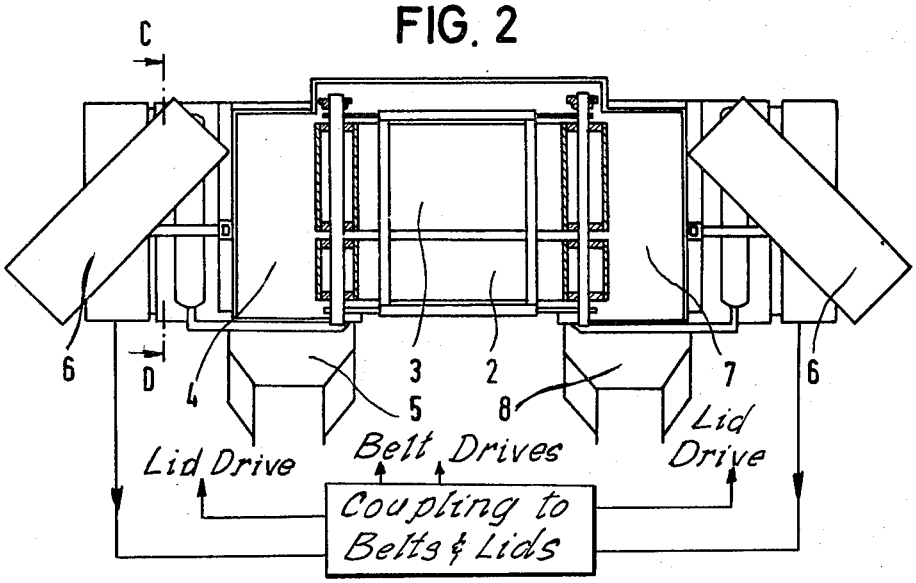
FIG. 2 is a top sectional view along the line E—F of FIG. 1.
Figure 3:
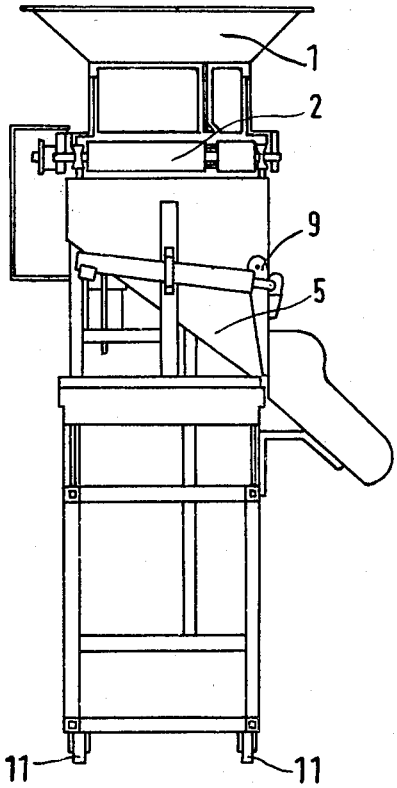
FIG. 3 is a side sectional view of the machine along the line C—D of FIG. 2.

Referring to the drawings, and particularly to FIG. 1, the goods are conveyed from ground or floor level into a hopper 1 through a conveyor belt which is not shown. From hopper 1, the goods reach the conveyor belts 2 and 3 (cf. FIG. 2). These conveyor belts have different widths and are respectively intended for bulk filling operation (belt 3) and dribble filling operation (belt 2).

A look at the left-hand part of the bagging machine shows that the goods are first conveyed through the conveyor belt 3 into the chute 4 with the outlet 5.

As the weighing means 6 approaches the filling weight the conveyor belt 3 is automatically reversed by the belt and lid coupling 13 which, as previously stated, couples the belt drive and the lids with the weighing means 6 so that it conveys the goods into chute 7 with the outlet 8. In the meantime, dribble filling takes place, which means that the goods are conveyed through the conveyor belt 2 into chute 4 and the outlet 5 until the required filling weight is attained and the belt 2 is reversed. Then the lid 9 is opened by means of drive 10 which, as previously stated, is coupled to the weighing means 6 so that the goods can be dumped into receptacles, bags or sacks which are placed underneath the outlet 5.

When the lid is closed again, the conveyor belt 3 for bulk filling is reversed again by the control 13 from conveying into chute 7 to conveying into chute 4, while the conveyor belt 2 conveys the final residual quantity necessary to attain the filling weight into chute 7 the belt 2 is reversed again, and the lid $9^1$, like the lid 9, is opened to discharge the goods into receptacles, the cycles of operation continuing as before.

In the drawing it can be noted that the means are symmetrically arranged and that the entire bagging machine can be displaced by means of rollers 11, 12.

The bagging machine in accordance with the present invention, which has a throughput capacity of 15 metric tons per hour, for instance, contributes considerable in increase of feed performance and accelerates the filling operation.

What is claimed is:

1. A machine for the filling of containers with goods, said machine comprising a hopper for holding a supply of the goods, a pair of spaced goods receiving means for receiving and for delivering the goods to separate containers, each receiving means being connected to weighing means for weighing the goods received in each said receiving means, a pair of conveyor belts disposed to convey goods from said hopper to one of said receiving means when they move in one direction and to the other receiving means when they move in the opposite direction, reversible drive means connected to said belts for driving each belt independently of the other, and means responsive to said weighing means and connected to said drive means for reversing the movement of one of said belts when the weight of the goods in a receiving means to which said one belt is delivering goods reaches a predetermined value and for reversing the movement of the other of said belts when the weight of the goods in a receiving means to which the other belt is delivering goods reaches a value high than said predetermined value, said other of said belts delivering goods to a receiving means at a rate lower than the rate at which said one of said belts delivers goods to a receiving means.

2. A machine as set forth in claim 1 wherein each of said goods receiving means is a chute having a closure lid and means for moving said lid for thereby permitting said goods to pass down the chute into a container.

3. A machine as set forth in claim 2 wherein said means for moving said closure lid is responsive to said weighing means.

4. A machine as set forth in claim 1 wherein said drive means drives one of said belts in one direction to deliver goods to one of said receiving means while it drives the other of said belts in an opposite direction to deliver goods to the other of said receiving means.

* * * * *

UNITED STATES PATENT AND TRADEMARK OFFICE

CERTIFICATE OF CORRECTION

PATENT NO. : 4,225,001

DATED : September 30, 1980

INVENTOR(S) : Gillenkirch

It is certified that error appears in the above-identified patent and that said Letters Patent are hereby corrected as shown below:

Column 2, line 17, after "lid" insert --9--

Column 2, line 18, cancel "by the control 13"

Column 2, line 52, change "high" to --higher--.

Signed and Sealed this

*Tenth* Day of *February 1981*

[SEAL]

*Attest:*

RENE D. TEGTMEYER

*Attesting Officer*

*Acting Commissioner of Patents and Trademarks*